US007481324B2

(12) United States Patent
Almonte

(10) Patent No.: US 7,481,324 B2
(45) Date of Patent: Jan. 27, 2009

(54) NIPPLE ADAPTER FOR BEVERAGE BOTTLE

(76) Inventor: Gina Marie Almonte, 11867 Skylake Pl., Temple Terrace, FL (US) 33617

( * ) Notice: Subject to any disclaimer, the term of this patent is extended or adjusted under 35 U.S.C. 154(b) by 54 days.

(21) Appl. No.: 11/457,813

(22) Filed: Jul. 16, 2006

(65) Prior Publication Data

US 2007/0012647 A1 Jan. 18, 2007

Related U.S. Application Data

(60) Provisional application No. 60/699,909, filed on Jul. 18, 2005.

(51) Int. Cl.
*A61J 9/00* (2006.01)

(52) U.S. Cl. ..... 215/11.1; 215/329; 215/386

(58) Field of Classification Search ..... 215/11.1, 215/11.4, 356, 386, 228, 329, 387; 222/566
See application file for complete search history.

(56) References Cited

U.S. PATENT DOCUMENTS

| | | | | | |
|---|---|---|---|---|---|
| 1,623,544 | A | * | 4/1927 | Kushner | 215/11.6 |
| 2,584,359 | A | * | 2/1952 | Miles | 215/11.4 |
| 2,771,073 | A | * | 11/1956 | Mills | 215/11.1 |
| 2,827,191 | A | * | 3/1958 | Baracate | 215/11.4 |
| 2,876,113 | A | * | 3/1959 | Barton | 426/117 |
| 3,090,531 | A | * | 5/1963 | Weaver et al. | 222/545 |
| 3,288,178 | A | * | 11/1966 | Johnson | 141/330 |
| 3,366,261 | A | * | 1/1968 | Dewey | 215/11.4 |
| D250,692 | S | * | 1/1979 | Bond et al. | D9/447 |
| 4,614,437 | A | * | 9/1986 | Buehler | 366/130 |
| 5,024,341 | A | * | 6/1991 | Dekerle | 215/11.1 |
| 5,257,650 | A | * | 11/1993 | Fisk et al. | 141/9 |
| 5,462,101 | A | * | 10/1995 | Mouchmouchian | 141/364 |
| 5,897,007 | A | * | 4/1999 | Schein et al. | 215/11.1 |
| 5,988,923 | A | * | 11/1999 | Arai | 401/262 |
| 6,161,710 | A | * | 12/2000 | Dieringer et al. | 215/11.4 |
| 6,415,937 | B1 | | 7/2002 | DeJong | |
| 6,669,013 | B1 | * | 12/2003 | Villanueva | 206/219 |
| 6,851,565 | B2 | | 2/2005 | Stephan | |
| 6,875,204 | B1 | * | 4/2005 | Hopkins et al. | 604/414 |
| 6,910,720 | B2 | * | 6/2005 | Shimei et al. | 285/331 |
| 7,185,775 | B1 | * | 3/2007 | Decal | 215/11.1 |
| 2002/0162816 | A1 | * | 11/2002 | Walsh | 215/11.1 |
| 2002/0190020 | A1 | * | 12/2002 | Noyd | 215/11.1 |
| 2004/0045841 | A1 | * | 3/2004 | Segovia et al. | 206/219 |
| 2006/0081551 | A1 | * | 4/2006 | Hegg | 215/11.1 |
| 2006/0081552 | A1 | * | 4/2006 | Jiang | 215/11.1 |
| 2006/0151420 | A1 | * | 7/2006 | Espenschied | 215/276 |

* cited by examiner

*Primary Examiner*—Sue A Weaver
(74) *Attorney, Agent, or Firm*—Stephen Powers

(57) ABSTRACT

An adapter designed to sealably couple a standard baby bottle nipple and cap to a beverage bottle, such as but not limited to a plastic water bottle. The adapter includes a generally cylindrical shaped base having a passage therethrough facilitating fluid flow. The adapter further includes a sealing disc extending in a perpendicular plane from the base and is of sufficient diameter to engage with the threads of the cap. The sealing disc engages with at least a portion of the bottom of the nipple disposed within the cap to substantially inhibit leakage. The adapter further includes a lip circumferentially disposed around one end of the base that is proximate the nipple when the sealing disc is engaged with the cap.

4 Claims, 1 Drawing Sheet

NIPPLE ADAPTER FOR BEVERAGE BOTTLE

PRIORITY UNDER 35 U.S.C SECTION 119(e) & 37 C.F.R. SECTION 1.78

This nonprovisional application claims priority based upon the following prior U.S. Provisional Patent Application entitled: Aqua Nipple On-The-Go, Application No.: 60/699,909, filed Jul. 18, 2005, in the name of Gina Marie Almonte, which is hereby incorporated by reference for all purposes.

FIELD OF THE INVENTION

The present invention relates to a nipple adapter, more specifically but not by way of limitation, a nipple adapter designed to sealably couple a standard baby bottle nipple and cap to a conventional beverage bottle such as but not limited to a plastic water bottle.

BACKGROUND

Caring for an infant or a young toddler is a very demanding task. Young children and infants require constant attention. Caretakers engaged in caring for a child are constantly performing tasks such as monitoring the safety of the child and ensuring the child receives the proper nutrition recommended for the child. Caretakers and parents routinely travel with their children. Whether transporting the child a short distance to a doctor's office or a trip of a much longer duration, young children require feeding at regular intervals. Caretakers and parents must be prepared to accommodate the needs of the child.

Younger children are routinely fed liquids through a conventional baby bottle with a nipple and cap that facilitates management of the consumption of the liquid disposed within the bottle by the child. Proper feeding of a young child requires that formula or other similar product only be given at certain intervals. It is common practice to provide the child some other liquid, such as but not limited to water or juice intermediate the feeding intervals using formula or related product.

One problem caretakers and parents encounter is being prepared to placate the needs of a thirsty child. As young children cannot consume liquids from a conventional beverage bottle without the presence of a nipple, an adapter must be used to couple a beverage bottle and a conventional baby bottle nipple and cap. Current adapters typically utilize threads to secure a baby bottle nipple and cap to a conventional beverage bottle. One problem with the current devices is that beverage containers often have different size and pitch of threads causing most adapters to fit improperly resulting in liquid leaking from the adapter when in use. Additionally, these current devices have been shown to be bulky, making them difficult to handle and requiring too much space when packing with other items normally packed in a travel bag when traveling with a child.

Accordingly, there is a need for a baby bottle nipple adapter that can be utilized on a plurality of conventional beverage containers such as but not limited to a plastic water bottle that sealably couples to the opening of the bottle a standard baby bottle nipple and cap without the use of threads on the adapter. Furthermore the baby bottle nipple adapter should substantially inhibit liquid from propagating around the baby bottle nipple adapter while a child is engaged in consuming the liquid disposed within the beverage bottle.

SUMMARY OF THE INVENTION

It is the object of the present invention to provide a baby bottle nipple adapter that sealably couples a baby bottle nipple to a plurality of beverage bottles.

It is a further object of the present invention to provide a baby bottle nipple adapter that utilizes a generally cylindrical shaped base to extend into the neck area of a conventional beverage bottle to sealably secure the adapter the to beverage bottle.

Another object of the present invention is to provide a baby bottle nipple adapter that utilizes an annular disc to engage with the internal threads of a conventional baby bottle nipple cap to releasably secure the adapter to the nipple.

A further object of the present invention is to provide a baby bottle nipple adapter that releasably couples a conventional baby bottle nipple to a conventional beverage bottle that inhibits liquid from propagating around the adapter.

Yet another object of the present invention is to provide a baby bottle nipple adapter that is manufactured from a lightweight and durable material.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
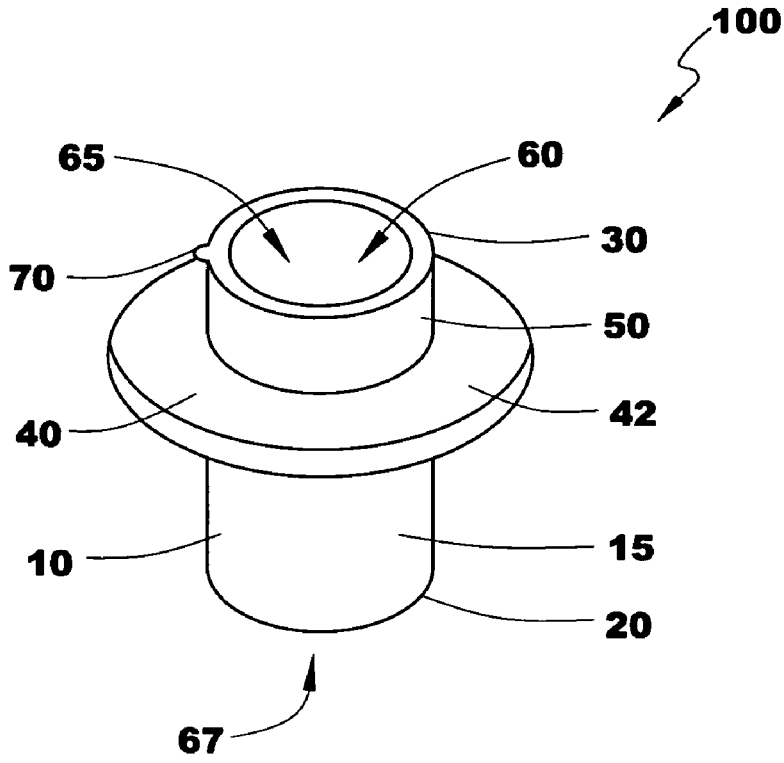
FIG. 1 is a perspective view of an embodiment of the present invention.
Figure 2:
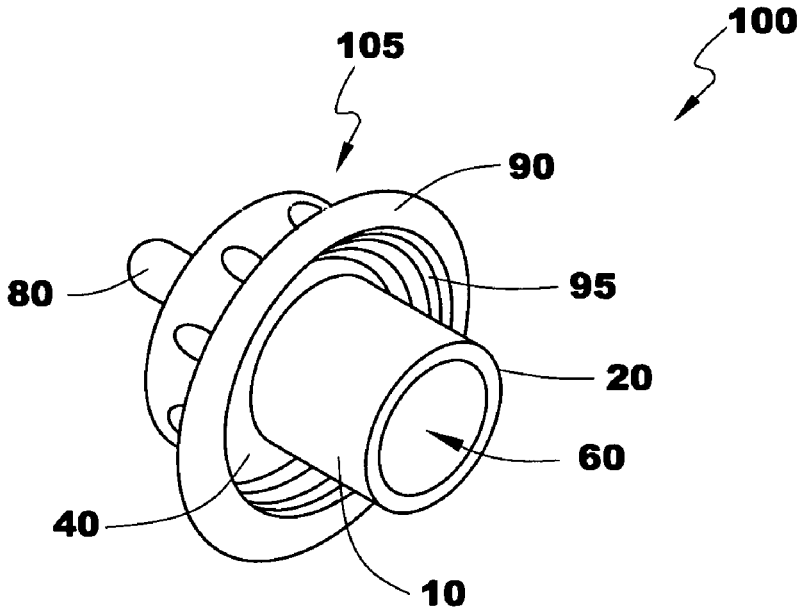
FIG. 2 is a perspective view of the present invention engaged with a conventional baby bottle nipple.

Now referring to the drawings submitted herewith, wherein the various elements depicted therein are not necessarily drawn to scale and wherein like reference numerals are used for like elements throughout the figures and in particular in FIGS. 1 and 2 there is a nipple adapter 100 constructed according to the principles of the present invention.

The nipple adapter 100 comprises a base 10 that is generally cylindrical in shape. The base 10 is manufactured from a suitable durable material such as but not limited to plastic. The base 10 has a section 15 that is designed to be inserted into the opening proximate the neck area of a conventional beverage bottle such as but not limited to a plastic water bottle. The section 15 of the base 10 is designed to engage with the internal surface of the opening of a beverage bottle. The base 10 is manufactured to be of an appropriate diameter whereby subsequent to insertion of the section 15 of the base 10 into the opening of a beverage bottle the adapter 100 is sealably secured by friction or press-fit method thereby substantially inhibiting the flow of liquid from the beverage bottle around the base 10 and facilitating the flow of liquid through the passage 60. Although no particular diameter is required good results have been achieved having a base 10 that is approximately seven-eighths of an inch in diameter.

Those skilled in the art will recognize that the base 10 could be manufactured to have numerous different diameters in order to sealably secure to a plurality of different types of beverage bottles.

The section 15 of the base 10 is of sufficient length to be insertably engaged with the internal surface of the opening of a beverage bottle. While no specific length is required, good results have been achieved with a base 10 having a section 15 that is approximately two-thirds of an inch in length. Those skilled in the art will recognize that the base 10 could be manufactured to have a section 15 of numerous different lengths and still achieve the desired function as referenced herein. It is further contemplated within the scope of the present invention that the base 10 could have a section 15 of different shapes in order to facilitate accommodation of different size openings of beverage bottles. More specifically but not by way of limitation the base 10 could be manufactured with a section 15 that is generally conical or tapered in shape gradually increasing in diameter distally from the end 20.

Extending from the base 10, intermediate ends 20, 30 is a sealing disc 40. The sealing disc 40 is contiguous with the base 10 and is generally annular in shape. The sealing disc 40 functions to sealably engage with the cap portion or cap 90 of a baby bottle top 105 as shown in particular in FIG. 2.

Referring now to FIG. 2, baby bottle top 105 includes a cap 90 that utilizes internal threads 95 for securing baby bottle top 105 to a baby bottle. Baby bottle top 105 further includes a nipple 80 that is mounted with a portion being disposed within the cap 90 and a portion extending through the cap 90 providing a method for a child to engage the baby bottle nipple 80.

The sealing disc 40 sealably engages with the internal threads 95 of the cap 90 and is secured proximate the bottom portion of the nipple 80 that is substantially disposed within the cap 90. The surface 42 of the sealing disc 40 engages with at least a portion of the interior of the cap 90 with the bottom portion of the nipple 80 intermediate thereto. Subsequent to attachment of the nipple adapter 100 to the baby bottle nipple and baby bottle top 105, the sealing disc 40 functions to inhibit the propagation of liquid around the nipple adapter 100 thereby substantially preventing any leakage of liquid during use of the nipple adapter 100 when the nipple adapter 100 is engaged with a beverage bottle.

Although no particular diameter is required, good results have been achieved with a sealing disc 40 that is approximately one and a half inches in diameter. Those skilled in the art will recognize that the sealing disc 40 could be manufactured in numerous different diameters in order to releasably secure to a plurality of conventional baby bottle nipple and caps 105. It is further contemplated within the scope of the present invention that the sealing disc 40 could be manufactured with additional methods of sealably securing to the cap 90. More specifically but not by way of limitation, the sealing disc 40 could be manufactured with locking tabs that function to engage with additional threads of the cap 90 providing an additional method of releasably securing the nipple adapter 100 to the cap 90.

Superposed to the sealing disc 40 is an upper section 50 of the base 10. The upper section 50 of the base 10 is contiguously mounted to the circumferential disc 40. Subsequent to attachment to a baby bottle nipple and baby bottle top 105 as shown in FIG. 2, the upper section 50 of the base 10 extends into the nipple 80 proximate the cap 90. Circumferentially mounted to the upper section 50 proximate the end 30 is a lip 70. Upon engagement of the nipple adapter 100 to a baby bottle nipple and baby bottle top 105, the lip 70 functions to engage with the internal surface of the nipple 80. This provides an additional method of sealably engaging the nipple adapter 100 to a baby bottle nipple 80 thereby substantially inhibiting any leakage of liquid from the nipple adapter 100 during use.

The base 10 further includes a passage 60 journaled therethrough to allow fluid flow. The passage 60 has two openings 65, 67 proximate ends 30 and 20 respectively. The passage 60 is manufactured to be of sufficient diameter to allow fluid to flow therethrough upon engagement with a beverage bottle. Those skilled in the art will recognize that the passage 60 could be manufactured in numerous different diameters and still achieve the desired function as described herein.

It is further contemplated within the scope of the present invention that the cap 90 and the nipple adapter 100 could be manufactured as a one-piece assembly through suitable methods such as but not limited to injection molding.

Referring in particular to FIGS. 1 and 2, a description of the operation of the nipple adapter 100 is as follows. In use, a user will insert the upper section 50 of the base 10 into the cap 90 of a standard baby bottle nipple. The user will engage the sealing disc 40 with the threads 95 of the cap 90 by rotating the nipple adapter 100 in order to sealably secure the nipple adapter 100 to the internal portion of the cap 90 of the baby bottle nipple and baby bottle top 105. Subsequent to securing the nipple adapter 100 to the baby bottle nipple and baby bottle top 105, the user will insert the section 15 of the base into the opening of a beverage bottle such as but not limited to a plastic water bottle. The user inserts the section 15 in a generally downward direction whereby the section 15 of the base 10 is sealably secured to the beverage bottle through a friction or press-fit method.

Following attachment of the nipple adapter 100 to the baby bottle nipple and baby bottle top 105 and a beverage bottle a user requiring the use of a baby bottle nipple and baby bottle top 105 to consume a liquid will consume the desired amount of liquid. During use, the fluid from the beverage bottle is transferred to the user via the passage 60 with openings 65, 67. Liquid is inhibited from leaking from the nipple adapter 100 by the sealing disc 40 and the lip 70.

After the liquid is consumed from the beverage bottle, the user will remove the nipple adapter 100 from the beverage bottle and the baby bottle nipple and baby bottle top 105 and clean using suitable methods in order to prepare for repeated use.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A device for facilitating the mating of a threaded cap configured for the opening of a first bottle to interface with the opening of a second bottle wherein the opening of the second bottle is smaller than the opening of the first bottle, comprising:

a base, said base being generally cylindrical in shape, said base having a passage extending therethrough, wherein said base is smaller in diameter that the opening of the second bottle, said base having a first end and a second end, said first end configured to be proximate the threaded cap when said device is engaged with the threaded cap, said base being configured to at least partially interface with the internal surface of the opening of the second bottle, wherein at least a portion of said base functions to sealably couple the threaded cap to the second bottle; and a disc, said disc extending from said base in a generally perpendicular manner, said disc being generally annular in shape and having a diameter greater than said base, said disc having a first surface and a second surface, said first surface of said disc configured to interface with at least a portion of the threaded cap, said disc being configured to at least substantially engage with the threads of the threaded cap.

2. The device as recited in claim 1, wherein said base includes a lip circumferentially disposed on said first end.

3. A device comprising:

a nipple;

a cap configured to receive a nipple, said nipple and cap operable to interface with a first bottle having an opening; and an adapter configured to interface said cap and said nipple with the opening of a second bottle, the opening of the second bottle having an opening of a different size than the opening of the first bottle, wherein said adapter is smaller in diameter than the opening of the second bottle;

said adapter including a base, said base being generally cylindrical in shape, said base have a first end and a second end, wherein at least a portion of said second end of said base interfaces with an internal surface of the opening of the second bottle, said base having a passage extending therethrough for fluid flow;

said adapter further including a sealing disc, said sealing disc extending from said base, said sealing disc being intermediate said first end and said second end of said base, said sealing disc operable to sealably engage said adapter with said cap;

said adapter further including a lip, said lip circumferentially disposed around said first end of said base, said lip configured to engage at least a portion of said nipple; and said sealing disc including a first surface and a second surface, said first surface being configured to interface with at least a portion of the nipple.

4. The device as recited in claim 3, wherein said cap is threaded.

* * * * *